US007506854B2

(12) United States Patent
Lukan

(10) Patent No.: US 7,506,854 B2
(45) Date of Patent: Mar. 24, 2009

(54) WALL MOUNTABLE RAZOR HOLDER

(75) Inventor: Sean Lukan, Milford, CT (US)

(73) Assignee: Eveready Battery Company, Inc., St. Louis, MO (US)

( * ) Notice: Subject to any disclaimer, the term of this patent is extended or adjusted under 35 U.S.C. 154(b) by 247 days.

(21) Appl. No.: 11/483,046

(22) Filed: Jul. 7, 2006

(65) Prior Publication Data

US 2007/0017833 A1 Jan. 25, 2007

Related U.S. Application Data

(60) Provisional application No. 60/698,537, filed on Jul. 11, 2005.

(51) Int. Cl.
*A47G 29/00* (2006.01)

(52) U.S. Cl. ..... 248/313; 248/316.1; 248/316.8

(58) Field of Classification Search ..... 248/313, 248/316.7, 316.8, 316.1, 312, 312.1
See application file for complete search history.

(56) References Cited

U.S. PATENT DOCUMENTS

| | | | | | |
|---|---|---|---|---|---|
| 1,366,528 | A | | 1/1921 | Ferguson | |
| 2,181,065 | A | | 11/1939 | Pfeiffer et al. | |
| D145,084 | S | | 6/1946 | Hutt et al. | |
| D150,507 | S | | 8/1948 | McEntire | |
| 2,471,825 | A | | 5/1949 | Long | |
| 2,474,899 | A | | 7/1949 | Hutt | |
| 2,616,647 | A | * | 11/1952 | Murchison | 248/110 |
| D181,876 | S | | 1/1958 | Nolan et al. | |
| 2,845,245 | A | | 7/1958 | Gray et al. | |
| 2,883,062 | A | | 4/1959 | Rosemark | |
| D237,666 | S | | 11/1975 | Iten | |
| D238,529 | S | | 1/1976 | Muller | |
| 4,120,073 | A | * | 10/1978 | Studebaker | 294/33 |
| D251,970 | S | | 5/1979 | Fujita | |
| D259,226 | S | | 5/1981 | Lester | |
| 4,275,862 | A | * | 6/1981 | Takagi et al. | 248/205.3 |
| D277,434 | S | | 2/1985 | Iten | |
| D283,076 | S | | 3/1986 | States, Jr. | |
| D294,903 | S | | 3/1988 | Pokorny | |
| 4,773,158 | A | | 9/1988 | Kertzman | |
| 4,784,360 | A | * | 11/1988 | Mok | 248/313 |
| 4,945,598 | A | | 8/1990 | Racioppi et al. | |
| 5,013,074 | A | * | 5/1991 | Galle | 294/33 |
| 5,065,918 | A | * | 11/1991 | Chun et al. | 224/191 |

(Continued)

FOREIGN PATENT DOCUMENTS

| | | |
|---|---|---|
| GB | 1243413 | 8/1971 |

OTHER PUBLICATIONS

International Search Report from PCT/US2006/026417, dated Oct. 31, 2006.

*Primary Examiner*—Korie Chan
*Assistant Examiner*—Steven Marsh
(74) *Attorney, Agent, or Firm*—Energizer Personal Care, LLC

(57) ABSTRACT

A wall mountable razor holder is provided. The razor holder has two pairs of curved arms extending from a back plate and wall mounting structure, such as a suction cup. The razor holder retains a safety razor at least one of two alternate positions. A head down position will ensure adequate drainage from the razor to ensure an erodable shaving aid body member of the razor will not soften from unnecessary contact with water. A head up position will be more familiar to a user.

9 Claims, 4 Drawing Sheets

U.S. PATENT DOCUMENTS

| | | | | |
|---|---|---|---|---|
| D333,583 | S | 3/1993 | Hurd | |
| D335,413 | S | 5/1993 | Lizanetz et al. | |
| D369,049 | S * | 4/1996 | Scaglione | D6/526 |
| D369,709 | S | 5/1996 | Triplett | |
| D370,375 | S | 6/1996 | Murgida et al. | |
| 5,937,537 | A * | 8/1999 | Miller | 34/97 |
| D423,845 | S | 5/2000 | Coffin et al. | |
| 6,202,963 | B1 * | 3/2001 | Derman | 248/110 |
| D451,642 | S | 12/2001 | Wagstaff | |
| 6,415,517 | B1 | 7/2002 | Worrick, III | |
| D464,222 | S | 10/2002 | Coffin et al. | |
| 6,619,604 | B1 | 9/2003 | Stillman | |
| 6,766,912 | B1 * | 7/2004 | Gibbs | 211/74 |
| D494,795 | S | 8/2004 | Bunnell et al. | |
| D495,179 | S | 8/2004 | Bunnell et al. | |
| D533,466 | S * | 12/2006 | Wonderley et al. | D9/749 |
| 7,216,721 | B2 * | 5/2007 | Jacobson et al. | 169/30 |
| 2003/0200660 | A1 | 10/2003 | Pennella | |

* cited by examiner

WALL MOUNTABLE RAZOR HOLDER

CROSS REFERENCE TO RELATED APPLICATIONS

This application claims the benefit of Provisional Patent application Ser. No. 60/698,537, filed Jul. 11, 2005.

BACKGROUND OF THE INVENTION

1. Field of the Invention

The present invention relates to safety razors in general and, more particularly, to wall mountable holders for safety razors.

2. Background Information

Modern safety razors comprise a razor cartridge mounted to a handle. Some modern safety razors, especially those marketed for women, may be sold with a wall mountable holder so that the razor may be conveniently stored close to where it is used, for instance on the wall of a shower or bathroom.

Many existing wall mountable holders fall into three broad groups. In a first group a holder of bifurcated construction takes advantage of characteristics of the razor shape to suspend the razor. Many razors are generally T-shaped or at least have one end, most usually the razor cartridge itself or razor cartridge end of the handle, wider than the opposing end of the handle. In this first group a pair of horizontally spaced arms extends from a wall mounting structure and simply suspends the razor from the wide part of the razor and with the widest end, usually the cartridge end, at the top. Examples of this first group include holders disclosed in U.S. Pat. No. 4,773,158 to Kertzman; U.S. Design Pat. No. D,333,583 to Hurd and U.S. Design Pat. No. D,294,903 to Pokorny. In a second group a simple cup extends from a wall mounting structure and the razor is simply placed in the cup, usually with the razor cartridge end of the razor at the top and facing out of the cup to prevent the razor blades of the cartridge contacting any internal part of the cup that might cause damage to the razor blades and result in an uncomfortable shave or lead to nicks and cuts for the user. Examples of this second group include U.S. Design Pat. Nos. D,464,222 and D,423,845 both to Coffin et al and U.S. Design Pat. No. D,370,375 to Murgida. In a third group a single prong extends from a wall mounting structure and this prong mates with a recess or hole in the handle to suspend the razor. In this group it is convenient to position the hole or recess in the handle at the handle end opposite the razor cartridge, consequently the razor is suspended with the razor cartridge end of the handle at the bottom. Examples of this third group are disclosed in U.S. Design Pat. Nos. D,277,434 to Iten and U.S. Design Pat. Nos. D,495,179 and D,494,795 both to Bunnell et al.

In a new type of razor, a relatively large body of erodable shaving aid material is further mounted to the handle and may surround the razor cartridge. The shaving aid body softens when exposed to water for extended periods and its wear rate is dramatically increased relative to the wear rate of a non-softened shaving aid body. Consequently the useful life of the shaving aid is greatly reduced which may lead to customer dissatisfaction. A softened shaving aid body is also highly susceptible to damage if the razor is accidentally dropped. Furthermore, this new type of razor is customarily provided with a protective cover. The protective cover conveniently protects the razor cartridge and shaving aid in travel but may act to retain moisture or water vapor in the vicinity of the shaving aid body that will prematurely soften the shaving aid body and result in an increased wear rate.

A disadvantage of holders of the first and second groups when used in conjunction with a razor of this new type is that the razor is stored with the razor cartridge at the top and water may not adequately drain from the razor after use. This may prevent the shaving aid body from adequately drying between uses. A disadvantage of holders of the third group when used in conjunction with a razor of this new type is that the holder's mating to the razor occurs in a region of the handle away from the razor cartridge and shaving aid body. Consequently it is possible the user of this type of holder may store her razor with the protective cover in place as there is no adjacent interfering structure to prevent this. This can be seen in FIG. 6 of Iten '434 where it is clearly shown that the razor holder is distantly spaced from the razor cartridge part of the razor, shown in broken line therein. The protective cover will retain moisture or water vapor in the vicinity of the shaving aid body that will prematurely soften the shaving aid body. A further disadvantage of holders of this third group is that the holder's functional feature is a prong. This provides less positive retention of the razor than holders of the first two groups. If the razor is accidentally bumped it may tend to fall from the holder.

Therefore, there is a need in the art to provide a wall mountable holder for a safety razor that will provide improved drainage for the razor; will only permit a razor to be retained without a protective cover and that will provide improved retention of the razor if the razor is accidentally bumped.

SUMMARY IF THE INVENTION

The wall mountable razor holder of the present invention comprises a back plate. The back plate defines a height and has a wall mounting structure. A first pair of preferably curved arms, horizontally spaced, extends forwardly from the back plate with their free ends directed toward one another. This first pair of arms defines a first width between their free ends. Each arm has a lip extending inwardly from the arm and the lip has an inner edge. A second pair of preferably curved arms, horizontally spaced, extends forwardly from the back plate with their free ends directed forwardly of the back plate. This second pair of arms defines a second width between their free ends. The second pair of arms is disposed higher on the back plate than the first pair of arms. Preferably, the first width is greater than the second width.

In a further aspect of the present invention the wall mountable holder removably retains a safety razor. The razor comprises a handle having a first end, a mid section and a second end and a razor cartridge removably coupled to the first end of the handle. The razor may further comprise an erodable shaving aid body removably coupled to the first end of the handle. The handle has a supportable surface at the first end. The razor is removably retained in the razor holder with the first end of the razor at a lower elevation than the second end. The first pair of arms partially surrounds the first end of the razor and the supportable surface abuts the lip of the razor holder. The second pair of arms partially surrounds the mid section of the razor. The location of the center of mass of the razor is such that a moment is caused to urge the mid section of the handle generally toward the second pair of arms.

In a further aspect of the present invention, the wall mountable holder removably retains the safety razor in a second position. In this second position the first end of the razor is at a higher elevation than the second end. In this second position, the first pair of arms partially surrounds the first end of the handle and the inner edge of the lip abuts the first end of the handle to suspend the razor.

In a still further aspect of the present invention, the wall mounting structure of the wall mountable holder comprises preferably one or more suction cups, or one or more screwed fasteners or double-sided adhesive tape.

The above features and advantages of the present invention will be more fully understood with reference to the following detailed description when taken in conjunction with the accompanying drawings.

DETAILED DESCRIPTION OF THE INVENTION

Figure 1:
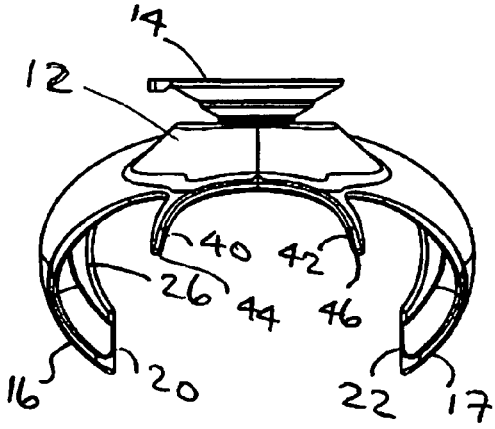
FIG. 1 is a top view of an embodiment of the razor holder of the present
Figure 2:
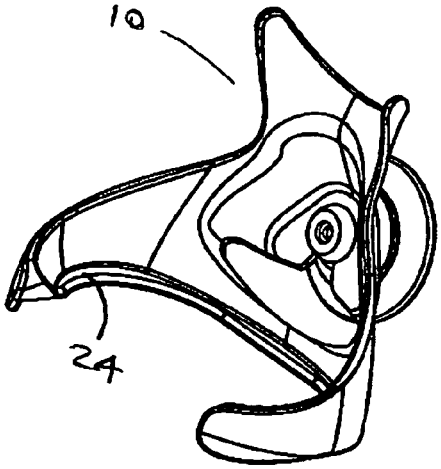
FIG. 2 is an isometric view from above of an embodiment of the razor holder of the present invention.
Figure 3:
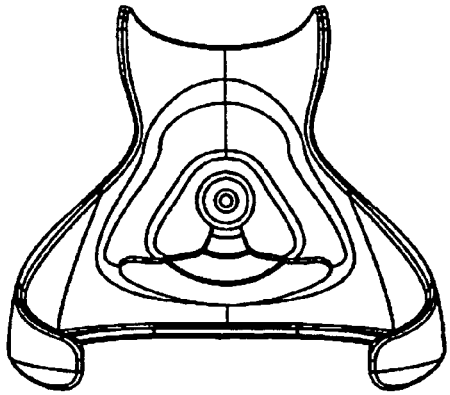
FIG. 3 is a front view of an embodiment of the razor holder of the present

Referring now to the drawings and in particular FIGS. 1-3, the wall mountable razor holder 10 comprises a back plate 12. The back plate defines a height and has a wall mounting structure. In the depicted embodiment the wall mounting structure is at least one suction cup 14. A first pair of preferably curves arms 16, 17, horizontally spaced, extends forwardly from the back plate with their free ends 20, 22 directed toward one another. This first from of arms defines a first width between their free ends. Each arm has a lip 24 extending inwardly from the arm. The lip has an inner edge 26. A second pair of preferably curved arms 40, 42, horizontally spaced, extends forwardly from the back plate with their free ends 44, 46 directed forwardly of the back plate. This second pair of arms define a space there between and a second width between their free ends. The second pair of arms is disposed higher on the back plate than the first pair of arms. In the preferred embodiment the first width is greater than the second width. The razor holder is preferably a molded thermoplastic, more preferably a commodity thermoplastic such as polypropylene, most preferably Cosmoplene AY564 sold by TPC. One of skill in the art will understand alternative materials or methods of manufacture may also be employed. Although the razor holder is shown as a one-piece molding, one of skill in the art will realize this could equally be made from two or more moldings permanently joined together.

Figure 6:
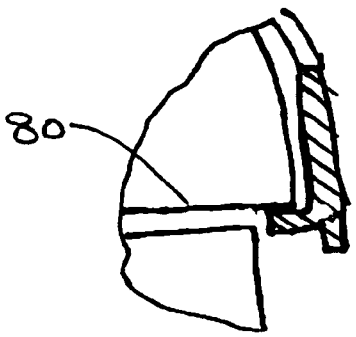
FIG. 6 is a partial front view of an embodiment of the razor holder of the present invention with a razor retained therein, showing the razor holder sectioned along lines 6-6 of FIG. 4.
Figure 4:
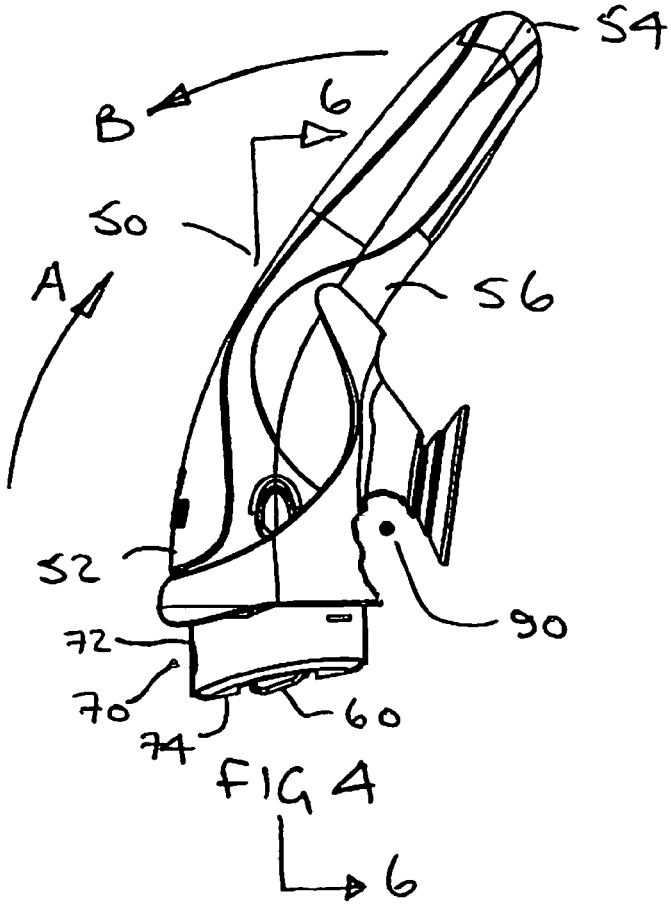
FIG. 4 is a side view of an embodiment of the razor holder of the present invention partially cut away, with a razor retained therein.
Figure 5:
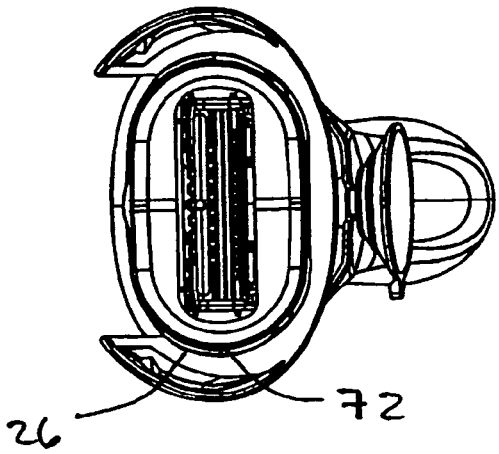
FIG. 5 is an underside view of an embodiment of the razor holder of the invention with a razor retained therein.

Referring now to FIGS. 4-6, a safety razor 50 is shown removably retained in the razor holder in a first position. The razor comprises a handle 52 having a first end 54, a mid section 56 and a second end 54. The razor further comprises a razor cartridge 60 and an erodable shaving aid body 70 both removably coupled to the first end of the handle. The erodable shaving aid body has a side surface 72 and an upper surface 74. The handle has a supportable surface 80 at the first end. The razor is removably retained in the razor holder with the first end of the razor at a lower elevation than the second end. Further, the upper surface of the erodable shaving aid body is at a lower elevation than the first pair of arms and the side surface of the erodable shaving aid body 72 is spaced apart from the inner edge of the lip 26. The first pair of arms partially surrounds the first end of the razor and the supportable surface abuts the lip. The second pair of arms partially surrounds the mid section of the razor. The location of the center of mass of the razor 90 is such that a moment is caused to urge the mid section of the handle generally toward the space between the second pair of arms, pictorially shown as arrow A. Furthermore this moment will overcome any small rotational displacement, for example 45°, of the second end of the handle in the direction of arrow B and this moment will return the razor to its retained position.

Figure 7:
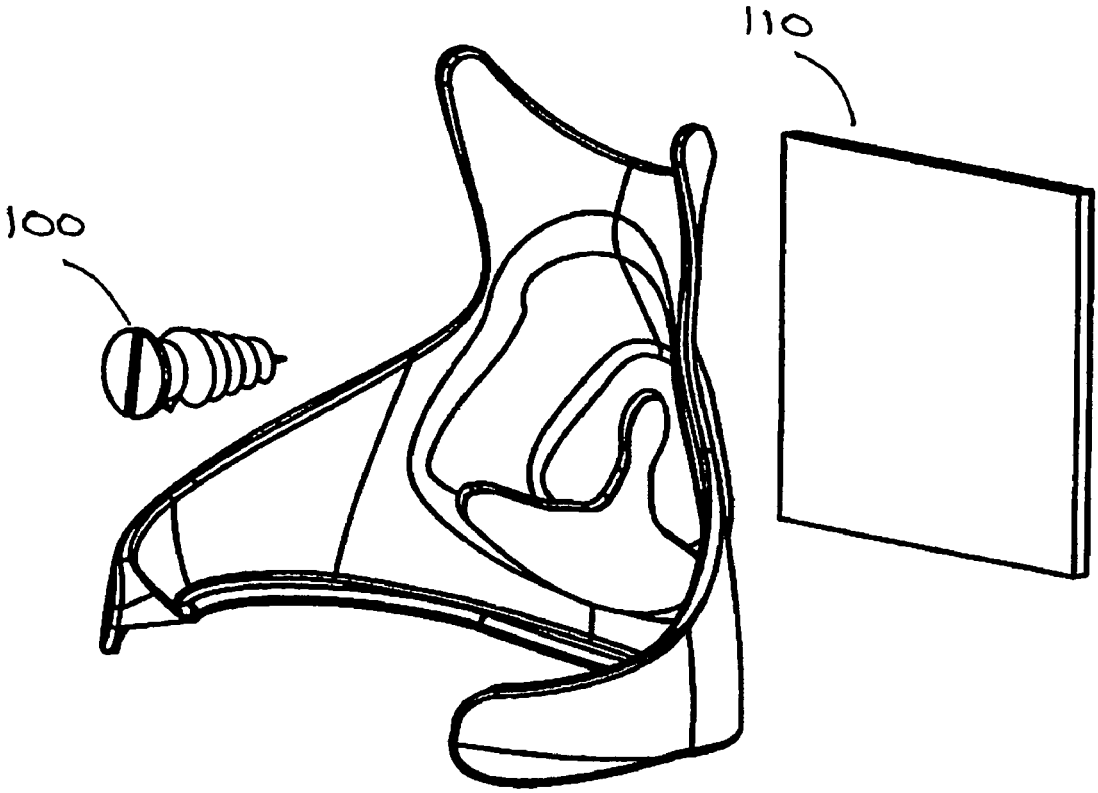
FIG. 7 is an exploded isometric view of an embodiment of the razor holder of the present invention showing alternative wall mounting structure embodiments.

Referring now to FIG. 7, alternative wall mounting structures are shown, in the alternative, in exploded format. Alternative wall mounting structure may be at least one screwed fastener 100. Further alternative wall mounting structure may be at least one piece of double-sided or double-faced adhesive tape 110.

Figure 8:
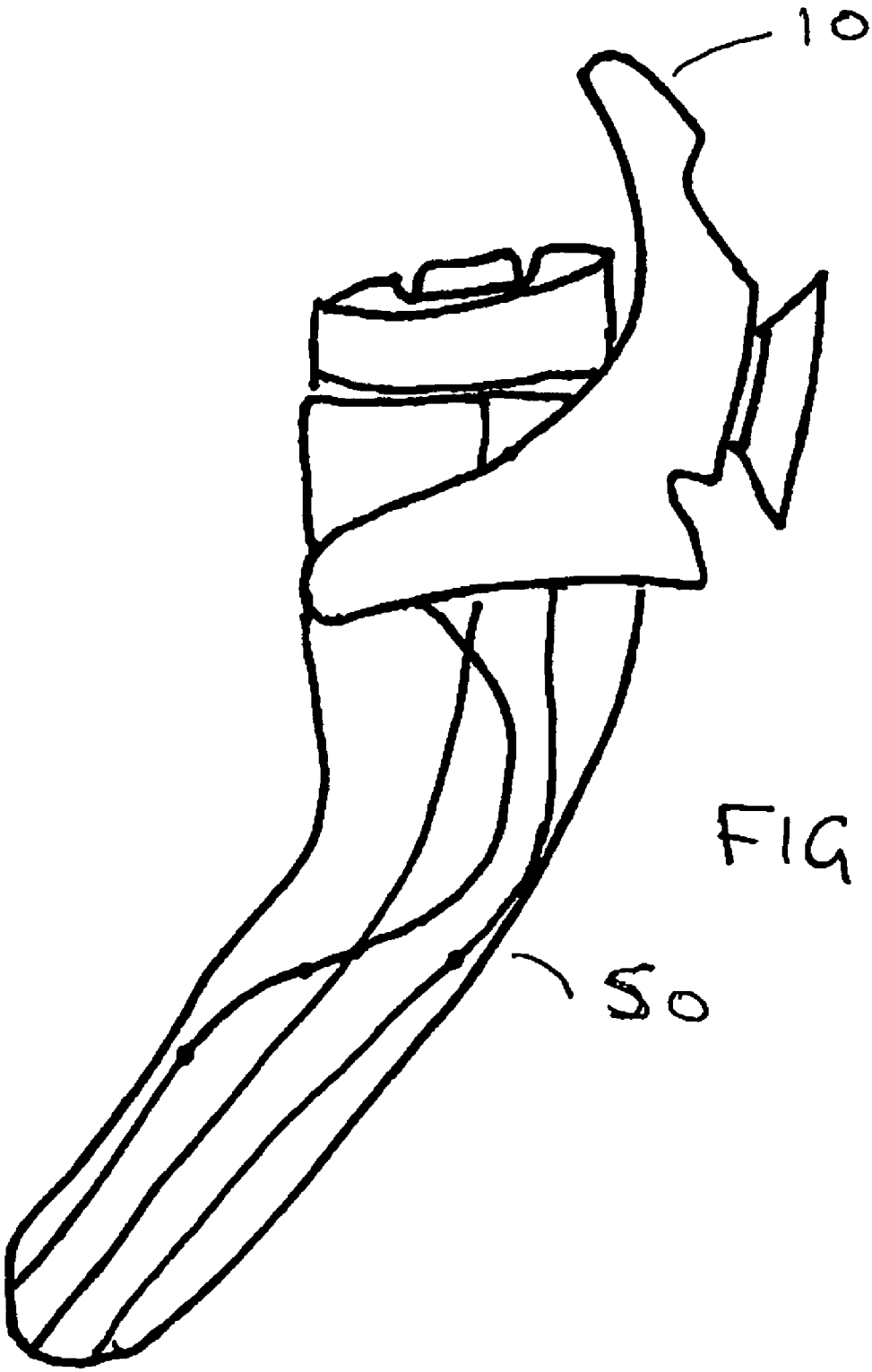
FIG. 8 is an isometric view of an embodiment of the razor holder of the present invention with a razor retained therein in a second position.

Referring now to FIG. 8, a safety razor 50 is shown removably retained in the razor holder 10 in a second position. In this second position, the first end of the handle is at a higher elevation than the second end. The first pair of arms partially surrounds the first end of handle and the inner edge of the lip of the first pair of arms abuts the first end of the handle suspend the razor.

It is to be understood that the present invention is by no means limited to the particular construction herein disclosed and/or shown in the drawings, but also comprises any modifications or equivalents within the scope of the disclosure.

What is claimed is:

1. A wall mountable razor holder, the razor holder comprising:

a back plate defining a height and having a wall mounting structure, a first pair of horizontally spaced curved arms, the arms extending forwardly from the back plate with their free ends directed toward one another and defining a first width between the free ends thereof, each arm having a lip extending inwardly from the arm, the lip having an inner edge, and;

a second pair of horizontally spaced curved arms extending forwardly from the back plate with their free ends directed forwardly of the back plate and defining a space therebetween and a second width between the free ends thereof, the second pair of arms being disposed higher on the back plate than the first pair of arms;

wherein the first width is greater than the second width;

wherein the razor holder removably retains a safety razor, the razor comprising: a handle, the handle having a first end, a mid section, a second end and a supportable surface at the first end; and a razor cartridge removably coupled to the first end of the handle;

wherein the razor is removably retained in the razor holder with the first end of the handle at a lower elevation than the second end, wherein the first pair of arms partially surrounds the first end of the handle and the supportable surface abuts the lip, and wherein the second pair of arms partially surrounds the mid section of the handle.

2. A razor holder according to claim 1, wherein the position of the center of mass of the razor retained in the razor holder causes a moment to urge the mid section of the handle generally toward the space between the second pair of arms.

3. A razor holder according to claim 2, wherein the razor further comprises a shaving aid body removably coupled to the first end of the handle.

4. A razor holder according to claim 3, wherein the shaving aid body has a side surface and an upper surface and wherein the razor is removably retained in the razor holder with the upper surface at a lower elevation than the first pair of arms.

5. A razor holder according to claim 4, wherein the side surface of the shaving aid body is spaced from the inner edge of the lip.

6. A razor holder according to claim 5, wherein the razor holder is a molded thermoplastic.

7. A razor holder according to claim 6, wherein the wall mounting structure comprises at least one suction cup.

8. A razor holder according to claim 6, wherein the wall mounting structure comprises at least one screwed fastener.

9. A razor holder according to claim 6, wherein the wall mounting structure comprises double-sided adhesive tape.

* * * * *